US006131197A

United States Patent [19]

Wang

[11] Patent Number: 6,131,197

[45] Date of Patent: Oct. 17, 2000

[54] BARBERSHOP PINAFORE

[75] Inventor: Ta-Tieh Wang, Chang-Hwa Hsien, Taiwan

[73] Assignee: Hwei Jix Hardware Company Ltd., Chang-Hwa Hsien, Taiwan

[21] Appl. No.: 09/368,141

[22] Filed: Aug. 5, 1999

[51] Int. Cl.[7] ..... A41B 13/10

[52] U.S. Cl. ..... 2/50; 2/88; 132/212

[58] Field of Search ..... 2/46, 48, 49.1, 2/50, 55, 88, 129, 135, 141; 132/212, 286

[56] References Cited

U.S. PATENT DOCUMENTS

| | | | |
|---|---|---|---|
| 1,062,497 | 5/1913 | Parkhurst | 2/50 |
| 1,216,088 | 2/1917 | De Vingo | 2/50 |
| 1,261,575 | 4/1918 | McLeod | 2/50 |
| 1,488,444 | 3/1924 | Shea | 2/50 |
| 1,837,848 | 12/1931 | Brothers | 2/50 |
| 2,243,505 | 5/1941 | Mercer | 2/50 |
| 2,364,568 | 12/1944 | Tiscornia | 2/50 |
| 2,527,098 | 10/1950 | Kenna | 2/50 |
| 2,717,389 | 9/1955 | Gribble et al. | 2/50 |
| 2,892,909 | 6/1959 | Darnutzer et al. | 2/50 |
| 2,921,626 | 1/1960 | Provenzano | 2/50 |
| 4,689,830 | 9/1987 | Williams | 2/50 |
| 5,950,236 | 9/1999 | Andrew et al. | 2/50 |

*Primary Examiner*—Michael A. Neas
*Assistant Examiner*—Gary L. Welch
*Attorney, Agent, or Firm*—Rosenberg, Klein, & Lee

[57] ABSTRACT

A barbershop pinafore, is essentially comprised of a cover, a ring frame, a fastening strap, shoulder bands, and a neck strap. Wherein, the cover is in cone shape with an opening, magic tapes are respectively provided in the middle of both sides of the opening and a stop is provided between both sides of said opening, the ring frame and the fastening strap are respectively provided on the lower and upper edges of the cover, a magic tape is provided to the outer side of one end and an extension at the other end of the fastener, a magic tape is provided to the inner side of said extension, one ring each is provided on both sides of the cover beyond the opening for retaining the shoulder band, a connection band with a guard ring is provided on the lower edge of the cover, the upper edge of the fastening strap is held in position by that of the neck strap, the neck strap circles around the outer side of the fastening strap and the end of the shoulder band can be adjusted against the adjustment guard ring.

1 Claim, 5 Drawing Sheets

BARBERSHOP PINAFORE

BACKGROUND OF THE INVENTION

1. Field of the Invention

The present invention relates to a modified pinafore used at a barbershop, and more particularly, to one that keeps its magic tapes from attracting hair, and allows adjustment of shoulder band depending on the body size of the individual client.

2. Description of the Prior Art

Whereas the prior art of the present invention, as illustrated in FIG. 4, is usually comprised of a cover(1), a ring frame(2), a fastening strap(3) and a pair of shoulder bands (4). Wherein, said cover(1) is in cone shape with an opening (11) provided on the top end and the side of the cover(1), a magic tape(111, 112) is each respectively provided in the middle of both sides of said opening(11). A stop(12) is provided in both sides of said opening(11). A ring frame(2) and a fastening strap(3) are respectively provided at the lower and the upper edges of the cover(1). A magic tape(31) is provided to the outer side of end and an extension(32) is provided at the other end of one end of said fastening strap(3). A magic tape(33) is provided in the inner side of the extension(32). A shoulder band(4) is each provided on the cover(1) beyond both sides of the opening(11). In practical use, as illustrated in FIG. 5, a client wears the cover(1) which is held in place by means of the magic tapes (111) (112) followed by the application of the magic tapes(31)(33) of the fastening strap(3); then the cover(1) is supported by means of the ring frame(2) and the shoulder bands(4) to collect the falling hair. However, the prior art is found with the defectives that it fails to keep of the falling hair from attaching to the magic tapes(31)(33), and it is not applicable to various body sizes of the clients since the shoulder bands(4) are not adjustable.

SUMMARY OF THE INVENTION

The primary objective of the present invention is to provide a barbershop pinafore, essentially comprised of a cover, a ring frame, a fastening strap, shoulder bands and a neck strap. Wherein, the cover indicates a cone shape with an opening at its top, a magic tape is each provided in the middle of both sides of said opening, and a stop is provided between both sides of said opening. The ring frame and the fastening strap are respectively provided on the lower and the upper edges of the cover. A magic tape is provided at the outer side and an extension at the other end of the fastening strap. A magic tape is provided in the inner side of the extension. A ring to retain the shoulder band is each provided on the cover external to both sides of the opening while a connection band with adjustment guard ring is provided to the lower edge of the cover. Furthermore, the upper edge of the neck strap is held in position by that of the fastening strap, and the neck strap circles around the outer side of the fastening strap. The end of the shoulder band can be adjusted against the adjustment of the guard ring, so that the falling hair will not be attracted to the magic tapes while the pinafore can be applicable to any body size of the client by adjusting the shoulder band.

DETAILED DESCRIPTION OF THE INVENTION

Figure 1:
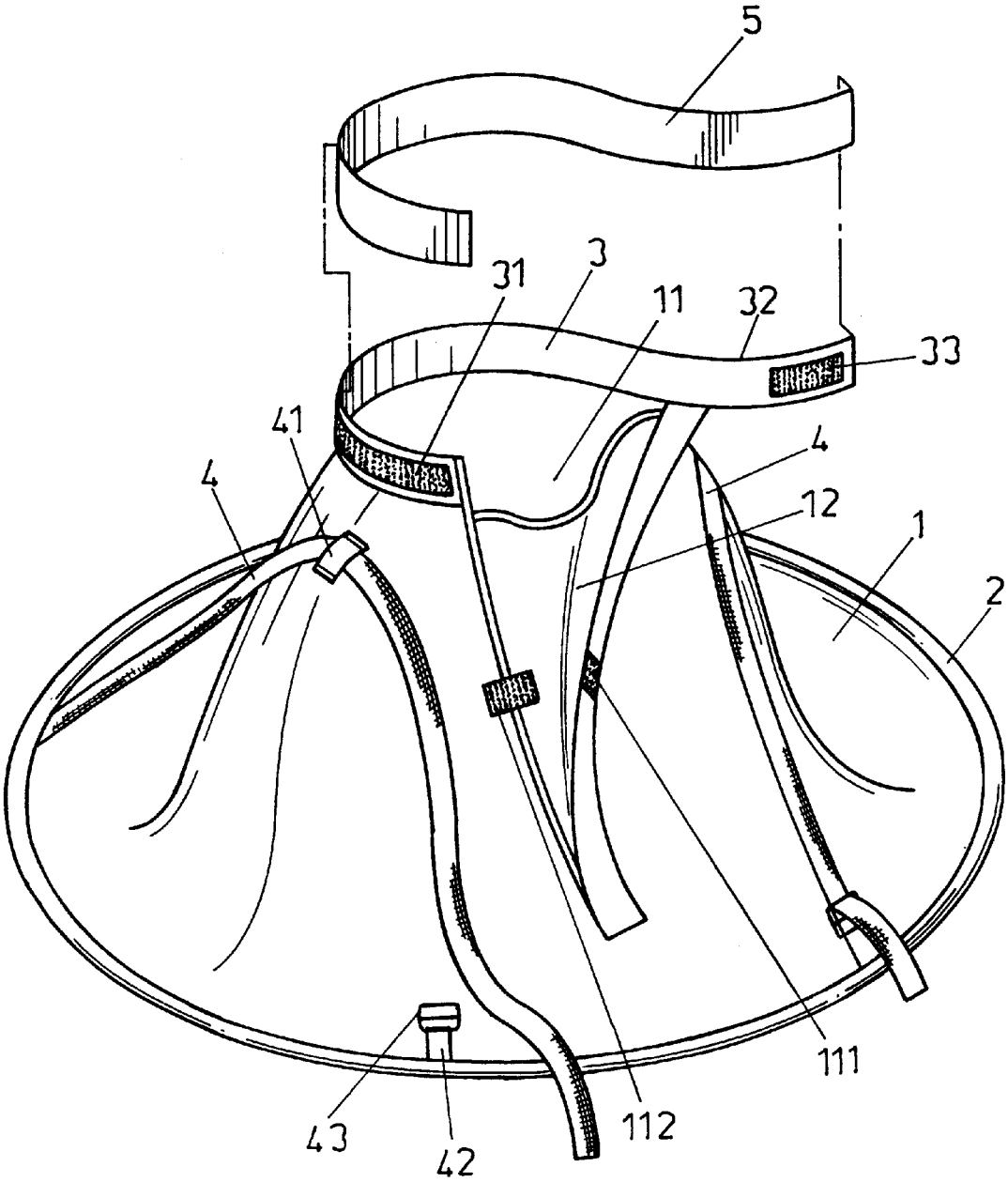
FIG. 1 is a blow-out view of the present invention.
Figure 2:
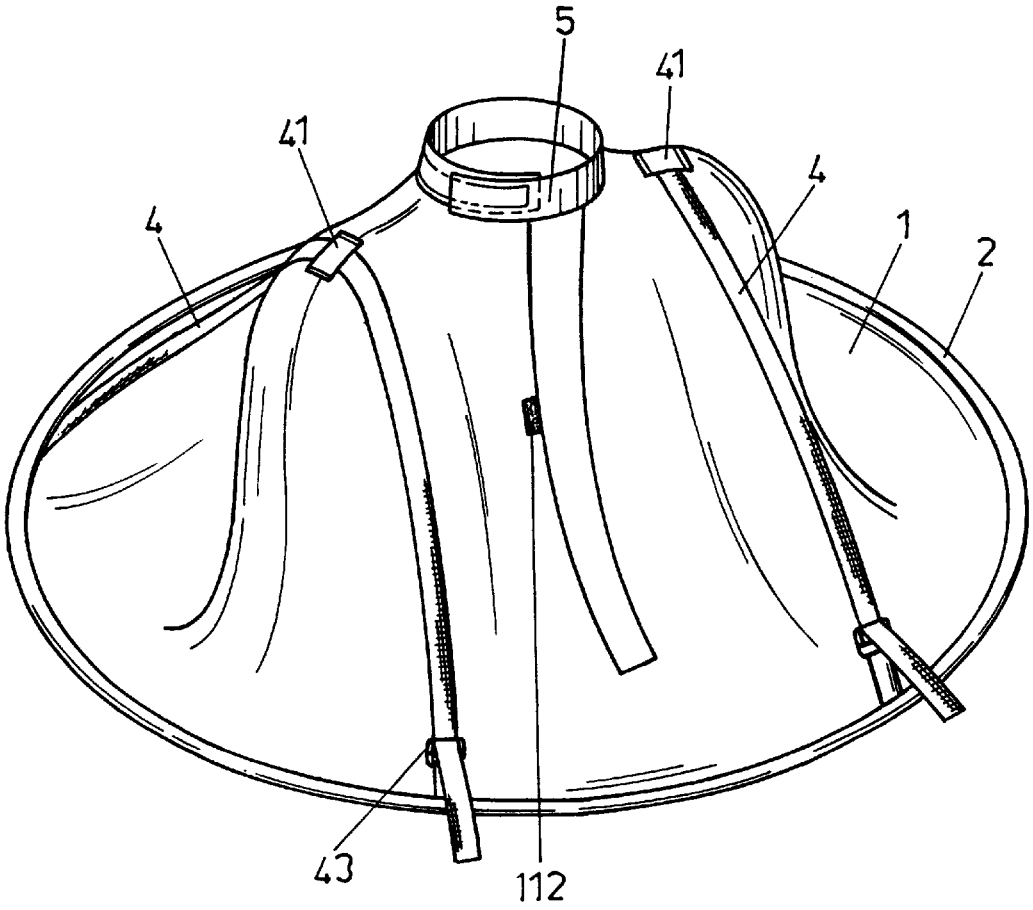
FIG. 2 is a view showing the appearance of the assembly of the present invention.

Referring to FIGS. 1 and 2, the present invention relates to a pinafore used at a barbershop that is essentially comprised of a cover(1), a ring frame(2), a fastening strap(3), a pair of shoulder bands(4), and a neck strap(5). Wherein, said cover(1) is in cone shape with an opening(11) provided at its top and side, magic tapes(111)(112) are respectively provided in the middle of both sides of the opening(11). A stop(12) is provided in both sides of the opening(11). The ring frame(2) and the fastening strap(3) are respectively provided on the lower and upper edges of the cover(1). A magic tape(31) is provided to the out side of one end and an extension(32) is provided to the other end of the fastening strap(3). That of the fastening strap(3) holds the upper edge of the neck strap(5) in position. The neck strap(5) circles around the outer side of the fastening strap(3). A magic tape(31) is provided to the outer side at one end of the fastening strap(3) which is provided on the upper edge of the cover(1), and an extension(32) is provided to the other end with a magic tape(33) provided inside the extension(32).

One ring(41) each is provided on the cover(1) external to both sides of the opening(11) to retain the shoulder band(4), while a connection band(42) with a guard ring(43) is provided at the lower edge of the cover (1). The guard ring(43) is used to slip on the end of the shoulder band(4) for adjustment. Furthermore, with the upper edge of the neck strap(5) being held in position by that of the fastening strap(3), the neck strap(5) circles around the outer side of the fastening strap(3).

Figure 3:
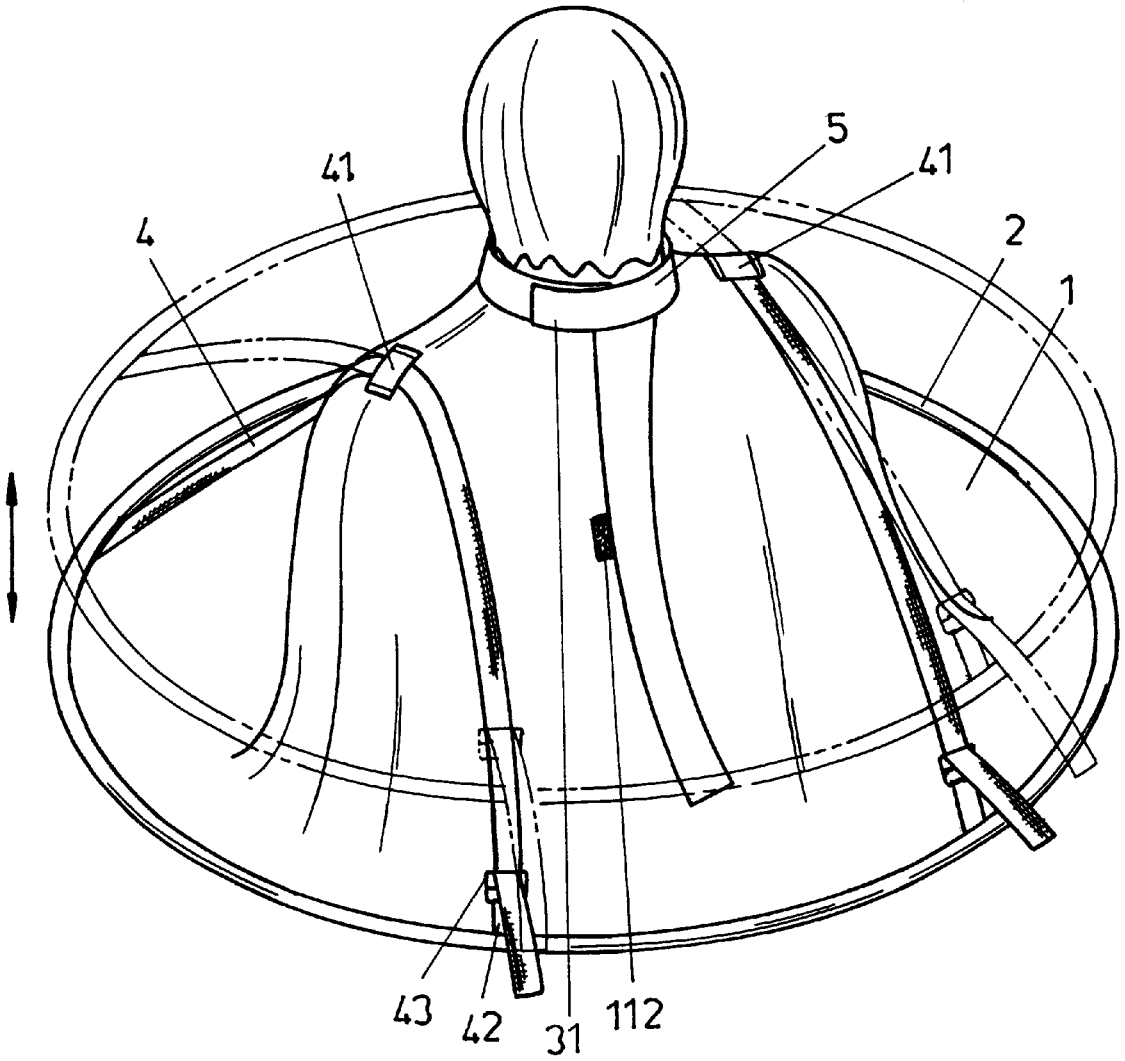
FIG. 3 is a view showing the operation of the present invention.
Figure 4:
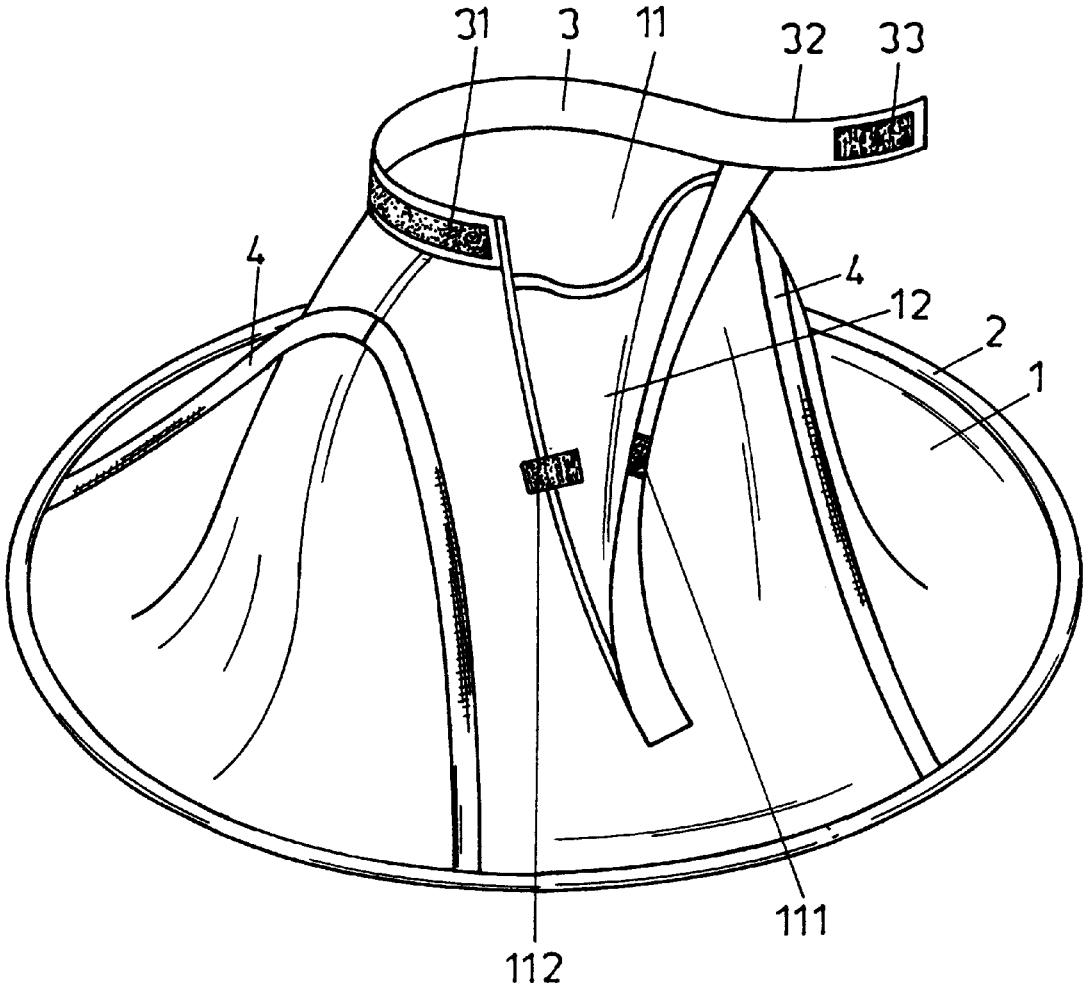
FIG.4 (PRIOR ART)
FIG. 4 is a view showing the appearance of the blow-out of the prior art of the present invention.
Figure 5:
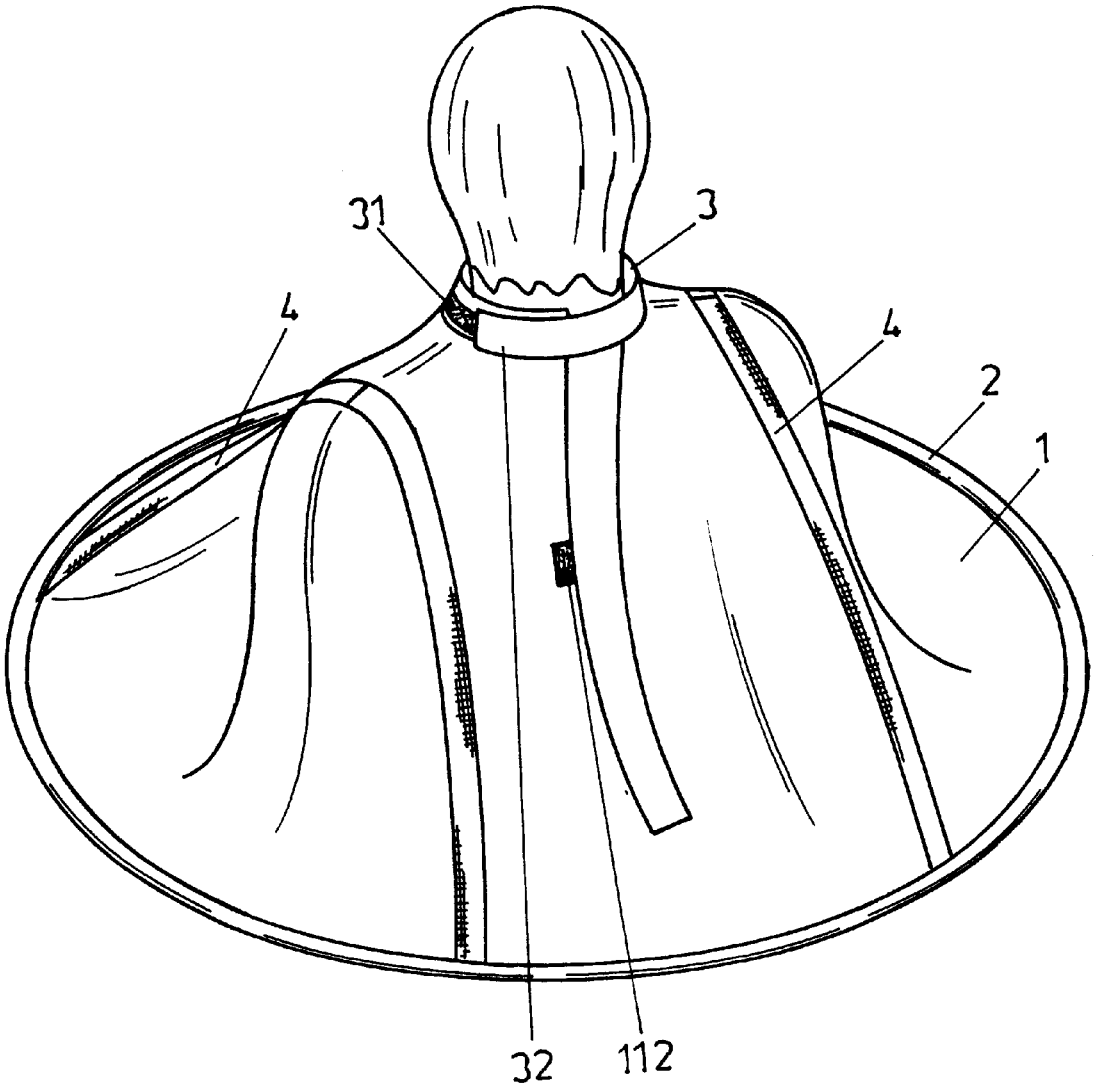
FIG.5 (PRIOR ART)
FIG. 5 is a view showing the operation of the prior art of the present invention.

In a preferred embodiment of the present invention as illustrated in FIG. 3, the client wears the cover(1) which is then held in position by the operation of said magic tapes (111)(112). Once the fastening strap(3) is also held in position by means of the magic tapes(31)(33), the neck strap(5) circles around the outer side of the fastening strap (3) to keep any hair from attaching to the magic tapes(31) (33). In addition, the shoulder band(4) slips into the guard ring(43) provided on the connection band(42) and can be adjusted depending on the body size of the individual client.

I claim:

1. A barbershop pinafore, essentially comprised of a cover, a ring frame, a fastening strap, shoulder bands, and a neck strap, within, the cover is in cone shape with an opening, magic tapes are respectively provided in the middle of both sides of the opening and a stop is provided between both sides of said opening, the ring frame and the fastening strap are respectively provided on the lower and upper edges of the cover, a magic tape is provided to the outer side of one end of the fastening strap and an extension is provided at the other end of the fastening strap, a magic tape is provided to the inner side of said extension, one ring each is provided on both sides of the cover beyond the opening for retaining the shoulder band, a connection band with a guard ring is provided on the lower edge of the cover, the upper edge of the fastening strap is held in position by the neck strap, the neck strap circles around the outer side of the fastening strap and the end of the shoulder band can be adjusted against the adjustment guard ring.

* * * * *